US005299882A

United States Patent [19]

Sayers

[11] Patent Number: 5,299,882

[45] Date of Patent: Apr. 5, 1994

[54] MECHANICALLY ACTUATED BARRIER SYSTEM

[76] Inventor: Donald L. Sayers, Rte. 3, Box 357A, Big Sandy, Tex. 75755

[21] Appl. No.: 892,170

[22] Filed: Jun. 2, 1992

[51] Int. Cl.[5] ..... E06B 11/02

[52] U.S. Cl. ..... 404/6; 49/270

[58] Field of Search ..... 404/6, 9; 49/269, 270

[56] References Cited

U.S. PATENT DOCUMENTS

| | | | |
|---|---|---|---|
| 440,996 | 11/1890 | Edwards | 49/270 |
| 558,188 | 4/1896 | Linquist . | |
| 721,600 | 2/1903 | Patrick . | |
| 1,205,208 | 11/1916 | Holland | 49/270 |
| 1,628,443 | 5/1927 | Thomas | 49/270 |
| 1,941,017 | 12/1933 | Mange et al. | 39/7 |
| 2,153,673 | 4/1939 | Nidever | 119/22 |
| 2,295,525 | 9/1942 | Ahlrichs . | |
| 2,299,986 | 10/1942 | Hummel | 268/35 |
| 2,544,215 | 3/1951 | Bootha | 49/270 |
| 2,861,366 | 11/1958 | Denison | 39/18 |
| 2,873,111 | 2/1959 | Voss | 268/37 |
| 3,775,912 | 12/1973 | Walls | 49/131 |

FOREIGN PATENT DOCUMENTS

| | | | |
|---|---|---|---|
| 252155 | 7/1927 | United Kingdom | 49/269 |

*Primary Examiner*—Timothy V. Eley
*Assistant Examiner*—John M. Husar
*Attorney, Agent, or Firm*—Konneker Bush & Hitt

[57] ABSTRACT

An openable barrier system for use with a horizontal surface. The system includes first and second support structures fixedly mounted to the horizontal surface an a barrier mounted to the first support structure and pivotable between a first position in which a latching mechanism incorporated with the second support structure securedly engages the barrier and a second position in which the barrier permits travel between the support structures. The latched engagement of the latch means and the barrier may be released from a first remote location. When the barrier is unlatched, spring energy sufficient to pivot the unlatched barrier into the second position is released. As the unlatched barrier pivots into the second position, a depressible pedal mechanically associated with the rotating member is raised. By later depressing the raised pedal, the rotating member may be rotated against the spring force to pivot the barrier into the first position. The latching mechanism then engages the barrier.

21 Claims, 3 Drawing Sheets

MECHANICALLY ACTUATED BARRIER SYSTEM

BACKGROUND OF THE INVENTION

Field of the Invention

This invention is related to a mechanically actuated barrier system and, more particularly, to a mechanically actuated barrier system operative from remote locations.

Description of Related Art

In recent years, electrically actuated gates, garage doors, and other types of barrier systems, particularly those controllable by a hand-held remote controller, have become increasingly popular. In spite of the many advantages of such systems, there are numerous situations where such electrically actuated barrier systems are undesirable. For example, remote locations such as park lands, pastures, fields and meadows are not readily accessible to an electrical power source. Furthermore, the cost of installing and maintaining an electrically actuated barrier system, particularly if it includes the installation of a electrical line to power the gate or other barrier, may not be cost effective for those barrier systems used infrequently.

Numerous mechanically actuated barrier systems have been previously disclosed. For example, U.S. Pat. No. 558,188 to Linquist disclosed a gate openable by a vehicle. In the Linquist system, when a vehicle depresses a first crank bend, a relatively complicated rope and pulley system associated therewith causes a sliding weight to shift, thereby shifting the counterbalance between the gate and sliding weight such that the gate is caused to swing upwardly. The opening of the gate would raise a second, reciprocating, crank bend, the depression of which would close the gate.

Other mechanically actuated barrier systems in which the opening and closing of a gate is controlled by vehicular depression of a remotely located shaft may be seen in U.S. Pat. No. 791,600 to Patrick, U.S. Pat. No. 2,295,525 to Ahlrichs and U.S. Pat. No. 2,861,366 to Denison. In Patrick, the barrier system includes a latch mechanism mounted to the gate and adapted to engage gate keepers mounted on first and second latch posts respectively positioned at the closed and open positions for the gate. To open the gate, a pulley system actuatable by a remotely located shaft first raises the gate to unlatch it in response to the vehicular depression of the shaft and then rotates the gate into the open position. Like Patrick, Alhrichs discloses a barrier system in which vehicular depression of a remotely located shaft lifts a gate mechanically associated therewith. However, once unlatched, the gate will swing into the open position under the influence of its own weight due to the shift in the gate's center of gravity caused by the lifting process. Finally, in Denison, a vehicular actuatable barrier system which includes ramps on either side of a gate is disclosed. Vehicular depression of the ramp causes draws the gate open and, upon release of the depression, draws the gate closed.

SUMMARY OF THE INVENTION

In one embodiment, the present invention is of an openable barrier system which includes a barrier movable between a first position in which the barrier impedes travel along a horizontal surface and a second position in which the barrier permits travel along the horizontal surface. At a first remote location, means, switchable between operative and inoperative modes, for moving the barrier into the first position are provided. Operatively connected to the moving means and the barrier are spring means. As the moving means moves the barrier into the first position, the moving means stores energy in the spring means and switches into an inoperative mode. Upon reaching the first position, latch means releasably latch the barrier in opposition to the stored energy in the spring means. At a second remote location, means for unlatching the barrier are also provided. When the barrier is unlatched, the spring means releases the energy stored therein, thereby moving the unlatched barrier into the second position and switching the moving means from the inoperative mode into an operative mode. In one aspect of this embodiment of the invention, the moving means are positioned on one side of the barrier and the unlatching means are positioned on the other side of the barrier and, in a second aspect of this embodiment of the invention, a second moving means and a second unlatching means, positioned at third and fourth remote locations, respectively, are also provided.

In another embodiment, the present invention is of an openable barrier system for use with a horizontal surface. The openable barrier system includes first and second support structures fixedly mounted to the horizontal surface. A barrier is mounted to the first support structure and is pivotable between a first position in which latch means incorporated with the second support structure securedly engages the barrier, thereby impeding travel between the support structures, and a second position in which the barrier permits travel between the support structures. Means for releasing the latched engagement of the latch means and the barrier are positioned at a first remote location. When the barrier is unlatched, first pivoting means, positioned within the first support structure, pivots the unlatched barrier into a second position. As the unlatched barrier pivots into the second position, second pivoting means for pivoting the barrier from the second position into the first position become operable.

In one aspect of this embodiment of the invention, the first pivoting means includes a rotating member positioned within the first support structure and means, connected to the rotating member and the barrier, for pivoting the unlatched barrier in response to rotation of the rotating member. Also positioned within the support structure and mechanically associated with the rotating member are spring means. Spring energy sufficient to pivot the barrier from the first position into the second position is stored in the spring means connected to the rotating member when the barrier is latched in the first position and is released when the barrier is unlatched, thereby rotating the rotating member in a first direction which pivots the barrier from the first position into the second position. In another aspect, the second pivoting means includes a depressible pedal and means, connected to the rotating member for raising the pedal into a depressible position in response to the rotation of the rotating member in the first direction. By depressing the raised depressible pedal, the rotating member is rotated in a second direction, thereby pivoting the barrier from the second position into the first position.

In yet another aspect of this embodiment of the invention, the means for releasing the latched engagement of the latch means and the barrier includes a third support structure fixedly mounted to the horizontal surface at the first remote location. A lever having one end extending into the interior of the third support structure is pivotable between first and second positions. Linkage means mechanically associate the lever end and rod means positioned within the second support structure such that the linkage means drives the rod means into releasing the latched engagement of the latch means and the barrier in response to pivoting the lever into the second position and resets the rod means such that the latch means may re-engage the barrier in response to pivoting the lever into the first position. In yet another aspect, the linkage means may extend from the interior of the third support structure, beneath the horizontal surface and into the interior of the second support structure.

In yet another aspect of this embodiment of the invention, a fourth support structure supported beneath the horizontal surface and having at least one sidewall defining an interior opening therein may be further provided. The depressible pedal is pivotally mounted to the sidewall, thereby defining a top wall for the fourth support structure.

BRIEF DESCRIPTION OF THE DRAWING

The present invention may be better understood, and its numerous objects, features and advantages will become apparent to those skilled in the art by reference to the accompanying drawing in which.

DETAILED DESCRIPTION OF A PREFERRED EMBODIMENT

Figure 1:
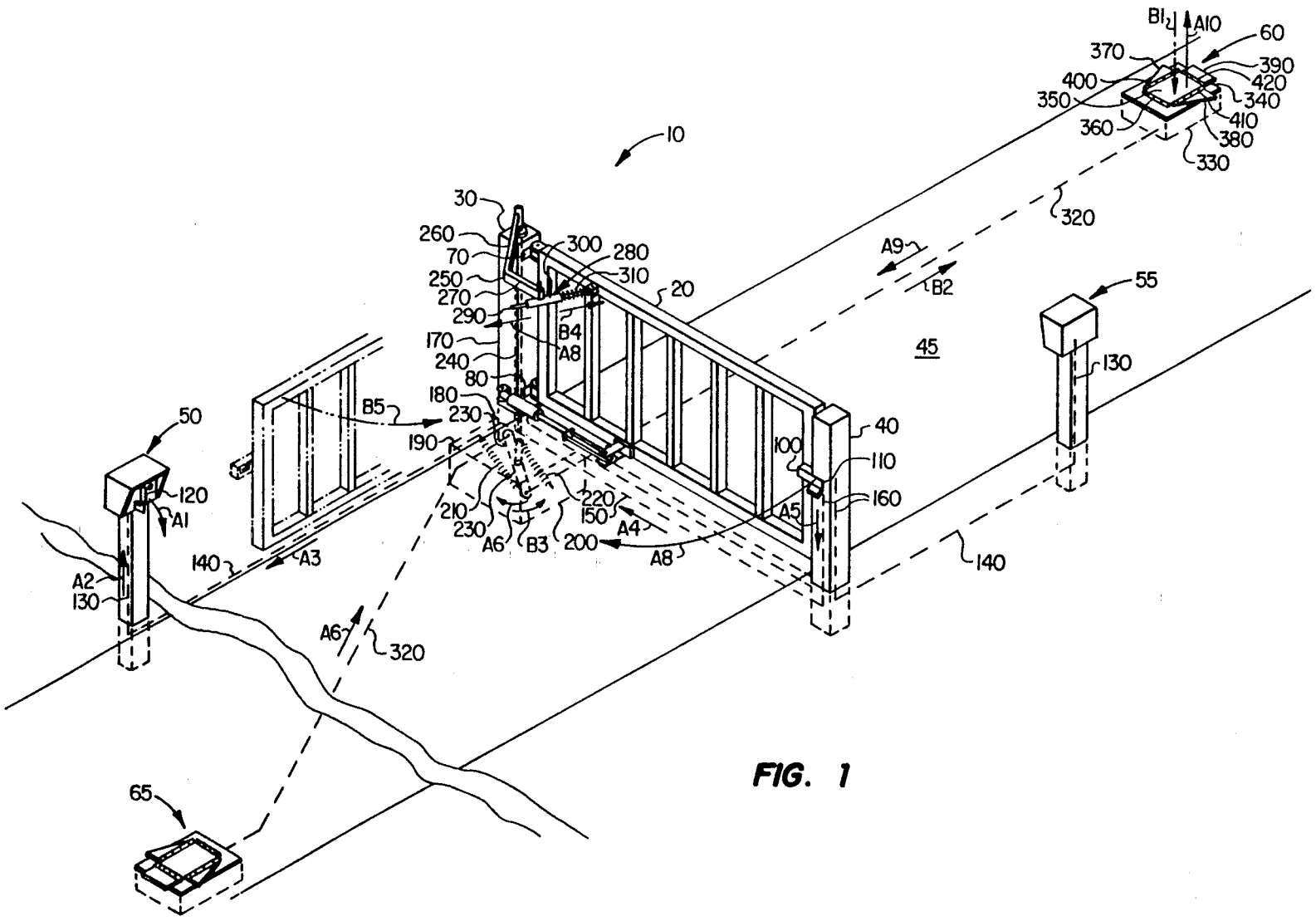
FIG. 1 is a perspective view of a barrier pivotally mounted to a first support structure and in latched engagement with a second support structure and an mechanically associated system for opening and closing the barrier, all constructed in accordance with the teachings of the present invention.

Referring first to FIG. 1, a mechanically actuated barrier system 10 for opening and closing a barrier associated therewith, for example, a horizontally swinging gate 20, and constructed in accordance with the teachings of the present invention, will now be described in greater detail.

The barrier system 10 includes the gate 20 mounted to a first support structure 30 fixedly mounted in the ground and pivotable between a first position (shown in solid in FIG. 1) where the gate 20 is in latched engagement with a second support structure 40 fixedly mounted in the ground, thereby impeding travel along a roadway 45 which passes between the first and second support structures 30, 40, and a second position (shown in phantom in FIG. 1) whereby the gate 20 permits travel along the roadway 45.

The barrier system 10 further includes at least one, and preferably two, third support structures 50, 55, each configured to mechanically initiate the opening of the gate 20 and at least one, and preferably two, fourth support structures 60, 65, each configured to mechanically initiate closing of the gate 20. In the preferred embodiment of the invention, each one of the third support structures 50, 55 should be fixedly mounted in the ground at first and second remote locations, relative to the first and second support structures 30, 40, on the left side of the roadway 45 on first and second sides of the gate 20, respectively. Additionally, each one of the fourth support structures 60, 65 should be buried in the roadway 45, with the upper side thereof flush with the surface of the roadway 45, on the first and second sides of the gate 20, respectively. In this manner, a vehicle approaching the closed gate 20 from either direction may open the gate 20 by operating equipment associated with the third support structure 50, 55 and close the gate 20 by operating equipment associated with the fourth support structure 60, 65. Furthermore, while the specific locations of the third and fourth support structures 50, 55, 60, and 65 may be readily varied without departing from the scope of the present invention, it has been found that positioning the first, second, third and fourth support structures 30, 40, 50, 55, 60, 65 such that the first and second support structures are separated by fourteen feet, the third support structure 50 is positioned twenty-four feet forward of the first support structure 30 at a four degree angle relative thereto, the third support structure 55 is positioned twelve feet past the second support structure 40, also at a four degree angle, the fourth support structure 65 is positioned thirty-five feet forward of the first support structure 30 at a twenty-six degree angle and the fourth support structure 60 is positioned twenty-five feet past the first support structure at a four degree angle has proven quite satisfactory in use.

The gate 20 is mounted to the first support structure 30 by upper and lower hinges 70, 80 and pivotable between a first, closed, position where the gate 20 is latched to the second support structure 40 and passage along a roadway 45 is blocked and a second, open, position where the gate 20 is unlatched and positioned such that it does not interfere with passage along the roadway 45. In the closed position, a gate catch 100 of the gate 20 is received in a notch 110 of the second support structure 40 where the gate catch 100 is held by a latching mechanism to be more fully described below, thereby securing the gate 20 in the closed position.

A lever 120 projects outwardly from the third support structure 50 and, as will be more fully described below, is mechanically associated with linkage means positioned in the interior of the third support structure 50. By unlocking the third support structure 50 and pulling the lever 120 downward in direction A1, linkage means 130, which is connected to the lever 120 by interconnection means (not shown in FIG. 1) within the third support structure 50, is pulled upwardly in direction A2. In turn, linkage means 140, which is connected to linkage means 120 by interconnection mean (also not shown in FIG. 1) within the third support structure 50, is pulled towards the third support structure 50 in direction A3 and linkage means 150, which is connected to linkage means 140 by interconnection means (not shown in FIG. 1) within the first support structure 30, is pulled in direction A4 towards the first support structure 30.

By pulling linkage means 150 towards the first support structure 30, linkage means 160, which is connected to linkage means 150 by interconnection means (not shown in FIG. 1) within the second support structure 40, is pulled downward in direction A5. As a result, the latching mechanism within the second support structure 40, in a manner to be more fully described below, releases the latched securement of the gate catch 100 within the notch 110 of the second support structure 40. The gate 20 will then swing into the open position (illustrated in phantom in FIG. 1) under the influence of a spring-driven mechanical force.

More specifically, the first support structure 30 is comprised of a post section 170 upon which the upper and lower hinges 70, 80 are mounted and a base section 180. The base section 180, which may be positioned below the surface as illustrated in FIG. 1 or may be at ground level, includes first and second sidewalls 190 and 200. Mounted to the first and second sidewalls 190, 200, respectively, are first ends of first and second tension springs 210, 220. The second ends of the first and second tension springs 210, 200 are connected to a rotating member 230. In the closed, latched, position, a spring force produced by expanding the tension springs 210, 220 while closing the gate 20 is stored in the tension springs 210, 220 and is released when the gate is unlatched.

A rotatable rod 240 (illustrated in phantom in FIG. 1) which extends vertically through the interior of the post section 170 and exits through the top surface thereof, is connected to the general center of the rotating member 230. Mounted to the rotatable rod 240 in the general proximity of the end thereof, is a first end of an arm 250. The other end of the arm 250, which, in the embodiment of the invention disclosed herein, may be comprised of first and second sections 260, 270 bent at an obtuse angle with respect to each other, is attached to gate connector means 280. Gate connector means includes a shaft 290 fixedly mounted on one end to the gate 20 and a slidable sleeve 300 mounted to the shaft 290 and slideably mounted to the section 270 of the arm 250. A spring 310 is mounted on the shaft 290 and connected, at opposite ends thereof, to the gate 20 and the sleeve 300, respectively.

When the gate 20 is latched, the spring force stored in the first and second tension springs 210, 220 attempts to exert a torque on the rotating member 230 which would rotate it in a clockwise direction. However, as the rotating member 230 is connected to the rotatable rod 240, which, in turn, is connected to the arm 250, the rotating member 230 is restrained by the gate 20 via the connecting member 280. A small displacement of the sleeve 300 may occur, however, depending on the relative spring constants of the tension springs 210, 220 with respect to the spring constant of the spring 310. When the latching mechanism releases the gate catch 100, the tension springs 210, 220 compress to a relaxed position, thereby turning the rotating member 230 and the rotating rod 240 approximately 90 degrees in direction A6. In turn, the rotating rod 240 would displace the arm 250, also in direction A6. The sleeve 300 would slide along the shaft 290 until reaching a travel limiter (not shown), at which point the arm 250 would begin pulling the gate 20 in direction A8 until reaching the open position.

The fourth support structure 60 includes a base section 330 buried in the ground and a pedal 340 connected to the base section 330 and forming an upper surface for the fourth support structure 60 which, when the gate is in the closed position, lays flush with the surface of the roadway 45. The pedal 340 includes a central section 350 connected to the base section 330 by a hinge 360 and first, second and third pedal flaps 370, 380, and 390, respectively connected to the central section 360 by hinges 400, 410, and 420. As the rotating member 230 rotates to open the gate 20, the movement of the rotating member 230 in direction A6 also pulls linkage means 320 connected to the rotating member 230 by interconnection mean (not shown in FIG. 1) in direction A9. The pulling force on linkage means 320, which is connected to the central section 360 of the pedal 340 by interconnection means (not shown in FIG. 1) within the base section 330, exerts an upward force on the central section 360 which lifts the pedal 340 from a lowered position in which the central section 360 and pedal flaps 370, 380, 390 lay flush with the surface of the roadway 45 into a raised position in which the central section 360 slopes upward from the hinge 360 to the hinge 420, typically to a height of approximately 4.5 inches above the surface of the roadway and the pedal flaps 370, 380, and 390 slope downward from the hinges 400, 410, 420 to the roadway 45, thereby preventing exposed edge surfaces of the central section 360 which could potentially damage the tires of a vehicle when the vehicle is later driven onto the central section 360 of the pedal 340.

After gate 20 has opened, and before the operator passes therethrough, the lever 120 should be returned to its original position, thereby resetting the latching mechanism positioned within the second support structure 40 by returning linkage means 160 to its original position, and the third support structure 50 re-locked. The operator may then pass through the gate 20, taking care to avoid inadvertently depressing the pedal unit 65, which would close the gate 20 before the vehicle has passed therethrough. After passing through the gate 20, the gate 20 ma be left open or be returned to the closed position. To close the gate 20 after passing therethrough, the operator should apply weight, for example, from a vehicle such as an automobile or truck, to the fourth support structure 60, for example, by slowly driving onto the now sloping central section 360 of the pedal 340. The weight of the vehicle would depress the central section 360 of the pedal 340 in direction B1, thereby causing the central section 360 to exert, via the aforementioned interconnection means, a pulling force on the linkage means 320 in direction B2. The pulling force on the linkage means, which is greater than the resistance of the tension springs 210, 220 to expansion, would pull the rotating member 230 in direction B3, thereby again storing spring force in the tension springs 210, 220. As the weight of the vehicle would return the pedal 340 to its original position, the rotating member would again be rotated ninety degrees. The rotating member 230 would rotate the rotatable rod 240, thereby turning the arm 250, also in direction B3. In turn, the sleeve 300 would slide along the shaft 290 in direction B4 until the spring 310 is compressed, at which time the gate 20 would begin to pivot in direction B5 towards the closed position. As the gatch catch 100 is again received within the notch 110, the latching mechanism would catch, thereby locking the gate 20 in the closed position. It is preferred that both a third support structure 55 and a fourth support structure 65 identical in construction to those already described herein be provided so that the operator of a vehicle is able to both open the gate 20 and close the gate 20 from either side thereof. It should be noted, however, that the exact configuration of the various linkage means which actuate the opening and closing of the gate 20 will vary, depending on the specific positioning of the third and fourth support structures 50, 55, 60, 65. For example, as the third support structure 55 is on the same side of the roadway 45 as the second support structure 40, the linkage means 150 and any additional interconnection means required therewith may be omitted. Similarly, the fourth support structure 65, is on the opposite side of the roadway as the first support structure 50, the linkage means 320 associated therewith will be positioned slightly differently.

Figure 2:
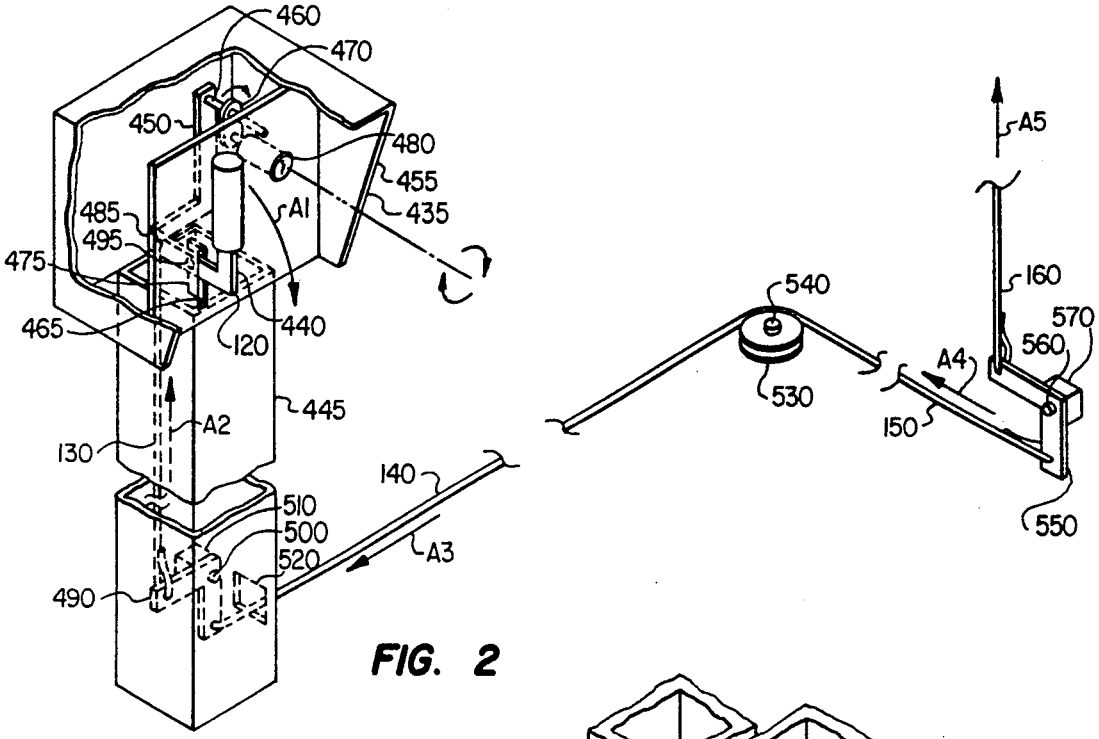
FIG. 2 is a partially cut away perspective view of a third support structure of the barrier system of FIG. 1 and mechanically associated components positioned within the first and second support structures.

Referring next to FIG. 2, the mechanically actuated operation by which the gate 20 is unlatched shall now be described in greater detail. As may be seen here, the third support structure 50 includes a housing 435 mounted to a hollow post 445 which extends into and is secured by the ground. The housing 435 includes a front plate 455 having a slotted aperture 465 formed therein and an interior plate 475 fixedly secured to the housing 435. As may now be seen, the lever 120 is a generally "L" shaped lever having a first segment 485 attached at one end to linkage means 130, rotatably mounted at the general center thereof to the interior plate 475 by a screw 495 and projecting through the slotted aperture 465, and a second segment 505 which extends along the exterior of the front plate 455 in a direction generally perpendicular to the first segment 485.

Also rotatably secured within the housing 435 by mounting means (not shown) is a generally "L" shaped blocking arm 515, one end of which is operably connected via a shaft 460 to a plate 470. Also operably connected to the plate 470 is a conventionally designed locking mechanism 480, the front end of which extends through the front plate 455 for operator access thereto. To open the gate 20 using the third support structure 30, an operator must first insert a key in the locking mechanism 480. By turning the inserted key clockwise, the blocking arm 450 is rotated from a first position which impedes movement of the lever handle 120 to a second position which does not interfere with movement of the lever handle 120. Once unlocked, the second segment 505 of the lever handle 120 may then be pulled in direction Al by the user. By pulling the second segment 495 of the lever handle 120 in direction A1, the lever handle 120 rotates about the screw 495, thereby rotating the first segment 485 of the lever handle 120 upward. As a result, linkage means 130, which, in the embodiment of the invention illustrated in FIG. 2, is a metal rod hookingly mounted to the first segment 485, is pulled in direction A2.

The other end of the rod forming linkage means 130 is hookingly mounted to one end of an L-shaped lever 490 and, secured to the other end of the lever 490, is the linkage means 140 which extends through an opening 520 in the post 380 and towards the first support structure 50. In the embodiment of the invention illustrated in FIG. 2, the linkage means 140 is a metal wire. In various embodiments of the invention, it is contemplated that the lever 490 may be mounted within the post 380 either above or below surface. Similarly, linkage means 140 may be located either a few inches above ground level or buried in a trench. Furthermore, while linkage means 140 is illustrated as a wire, it is specifically contemplated that the configuration of the linkage means may be varied without departing from the present invention. For example, it is contemplated that the linkage means may be a metal rod similar to that used as linkage means 130. Additionally, while the linkage means is disclosed as unshielded, it is further contemplated that the linkage means 140, either in wire, rod or other configuration, may be enclosed in a section of conduit constructed of PVC or other suitable material. The use of a conduit to enclose the linkage means 140 would protect the linkage means 140 from damage or interference with operation and would be particularly useful if the linkage means 140 were buried in a trench.

The lever 490 is rotatably mounted by screw 500 to an interior panel 510 fixedly secured to the post 380. The upward pulling motion of linkage means 130 in direction A2 causes the lever 490 to rotate around the axis of the screw 500, thereby pulling linkage means 140 in direction A3. Linkage means 140 extends to the first support structure 30 where it circumferentially engages a rotatable pulley 530 which directs the linkage means 140, which on the other side of the pulley is referred to as linkage means 150, towards the second support structure 40 in direction A4. Shaft 540 secures the pulley 530 within the interior of the first support structure 50. In one embodiment, the pulley 530 may be positioned in the portion of post section 170 below ground, in which embodiment, the post section 170 should include first and second apertures through which the linkage means 140 and 150 may extend therethrough. Alternately, the pulley 530 may be positioned within the base section 180, in which case, the base section 180 would require the aforementioned access apertures. Finally, if rods are utilized as both linkage means 140 and 150, the pulley 530 must be replaced by an L-shaped lever hookingly engaged to the linkage means 140 and 150 on opposite ends thereof and similar in design and operation as those disclosed elsewhere herein.

From the interior of the underground portion of the first support structure 50, linkage means extends through an aperture (not shown) in the first support structure 30 and, via a PVC conduit, underneath the roadway 45 towards the second support structure 40. Linkage means 150 extends through an aperture (not shown) in the portion of the second support structure 40 below ground where it is hookingly engaged with a first end of a L-shaped lever 550 rotatably mounted by screw 560 to a plate 570 in the interior of the second support structure 40. Hookingly mounted to the other end of the lever 550 is linkage means 550. Thus, when the vehicle operator pulls the lever 440 to open the gate 20, linkage means 150 is pulled in direction A4. The lever 550 rotates about the screw 560, thereby driving linkage means 160, which, in the embodiment of the invention disclosed herein, is a metal rod hookingly engaged to the L-shaped lever 550, in direction A5.

Figure 4:
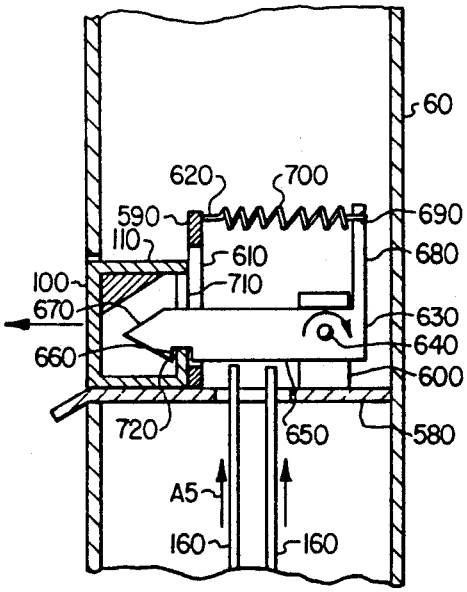
FIG. 4 is a partially cross-sectioned, interior side elevational view of the second support structure of FIG. 3 taken along lines 4—4.
Figure 3:
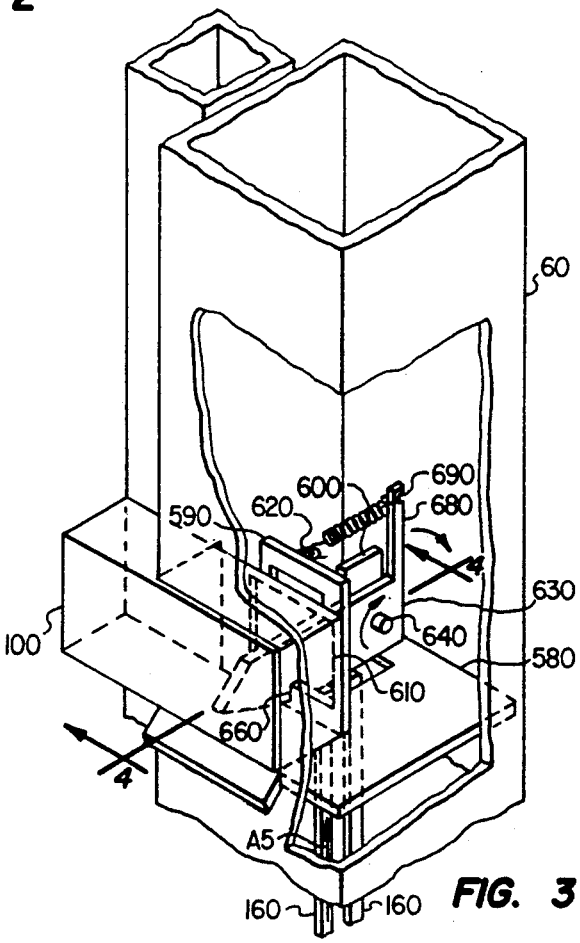
FIG. 3 is a partially cut away perspective view of the second support structure of FIG. 1.

Referring next to FIGS. 3 and 4, the unlatching of the gate 20 shall now be described in greater detail. Mounted within the interior of the second support structure 40 in the general proximity of the notch 110 is a horizontal plate 580. Upwardly extending therefrom are first and second vertical plates 590 and 600. The first vertical plate 590 has an aperture 610 formed in the general center thereof and an eyelet 620 mounted thereto. A latch 630 is pivotally mounted to the second vertical plate 600 by a screw 640. The latch 630 includes a main body portion 650 having a notch 660 formed therein, a tapered end portion 670 at one end thereof and a projection 680 extending generally orthogonal to the main body portion 650 at the other end. The projection 680 has a notch 690 formed therein in the general proximity of its free end. Spring means 700, for example, an extension spring of conventional design and having an unextended length less than the separation between the eyelet 620 and the notch 690, is hookingly engaged, at one end, to the eyelet 620 and, at the other end, to the notch 690 such that the spring means 700 exerts a compressive force which pulls on the projection 680.

The gate catch 100 has an interior aperture 710 in which, when the gate 20 is in the closed position, the latch 630 is received therein and latched by aperture lip 720 which is received in the notch 660, thereby securing the gate 20 in the closed position. When an operator pulls the lever 420 downward to open the gate 20, the resulting mechanism previously described drives linkage means 160 upwardly in direction A5. The linkage means 160 exerts a pushing force on the latch 630 which, as it pivots about the axis of the screw 640, is driven upward a sufficient distance to disengage the engagement between the lip 720 and the notch 660. Having released the secured engagement between the gate 20 and the second support structure 40, the gate 20 will begin opening under the influence of the mechanism already described.

Figures 5, 6:
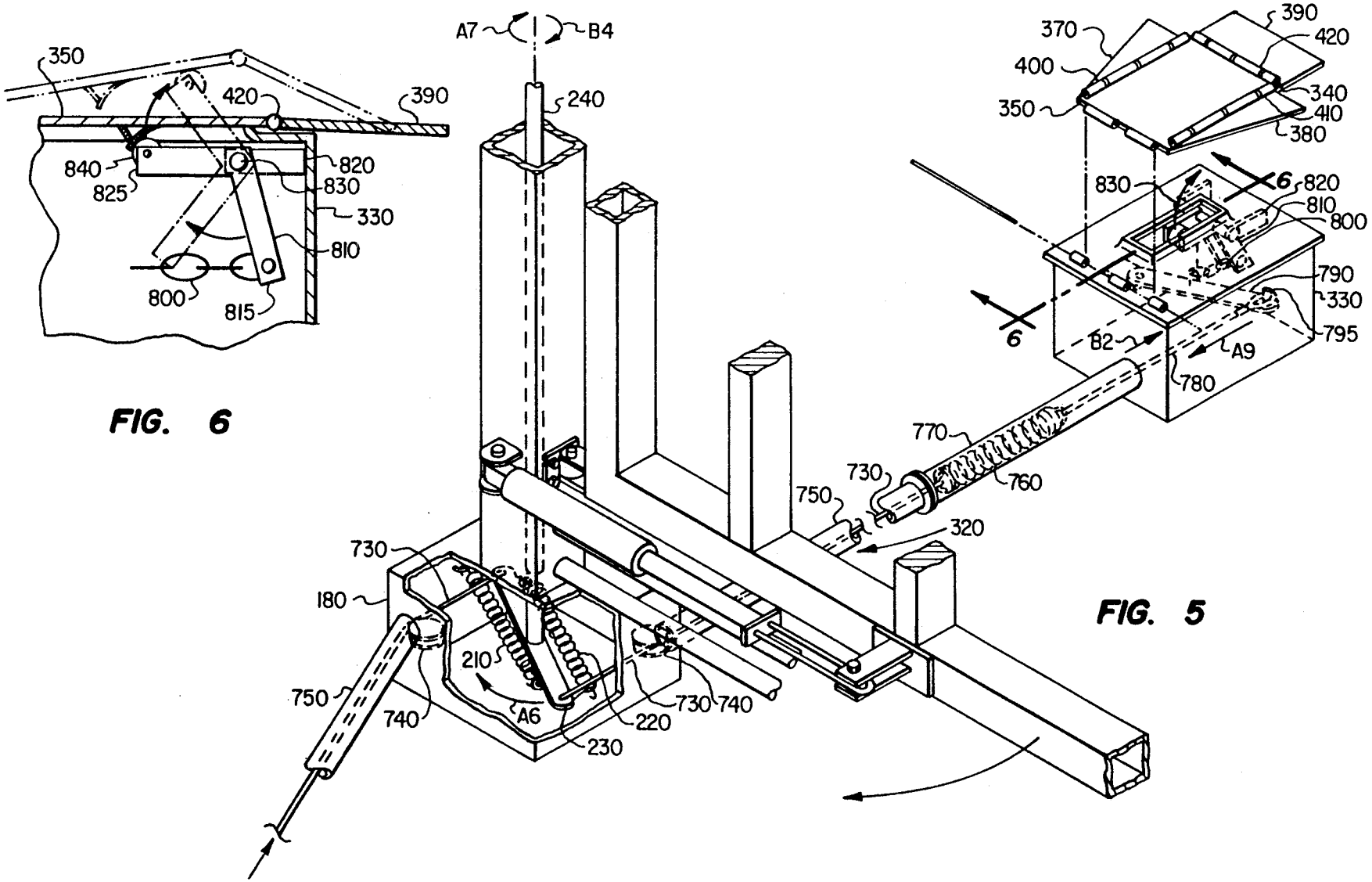
FIG. 5 is a partially cut away, partially exploded, perspective view of the first and fourth support structures of FIG. 3.
FIG. 6 is a cross-sectional view of the fourth support structure of FIG. 5 taken along lines 6—6.

As may be best seen in FIG. 5, after the second support structure 40 releases the latched engagement of the gate 20, the tension springs 210, 220 which, as previously described, have been held in an expanded position and have a significant amount of spring force stored therein, compress into the rest position, thereby turning the rotating member 230 in direction A6 which, as previously described, actuates the opening of the gate 20. In addition, by turning the rotating member 230, the linkage means 320 is pulled towards the first support structure 30 in direction A9. As may now be seen in detail, the linkage means 320 includes a first cable 730 connected to the rotating member 230 and extending outwardly therefrom. A pulley 740 redirects the cable 730 through an opening (not shown) in the base section 180 and into a conduit 750 buried underneath the roadway 20. The other end of the cable 730 is connected to a damping spring 760 encased in a housing 770, also buried underneath the roadway 20. As the cable 730 is pulled in direction A9, a second steel cable 780 connected to the other end of the damping spring 760 is also pulled in direction A9 towards the first support structure 30.

Mounted within the base section 330 of the fourth support structure 60 is a rotatable member 790, one end is rotatably secured within the base section 330 by securement means (not shown) and the other end of which includes a projection 795 to which the cable 780 is hookingly engaged thereto. As the rod 780 is pulled in direction A9, the free end of the rotating member 790 is pulled in direction A9 as well. As linkage means 800, which, for example, may be a metal chain, is attached to the general center of the rotating member 790, the linkage means 800 is pulled forward. In turn, an L-shaped lever 810 having a first section 815 secured to the linkage means 800, a second section 825 having a rotatable bearing 840 mounted thereto and secured to a support member 820 of the base section 330 by securement means 830, for example, a bolt, is rotated, thereby raising the central section 350 and the pedal flap 390 of the pedal 340 as illustrated in FIG. 6, as well as the pedal flaps 370, 380, which have been omitted from FIG. 6 for ease of illustration.

In the open position, the gate 20 may be closed by applying weight to the central pedal section 350 of the fourth support structure 40. By exerting a downward force on the central pedal section 350, the second section 825 of the L-shaped lever 810 is pushed downward, thereby pulling linkage means 800. In turn, the rotating member 790 is pulled forward, thereby drawing rod 780 in direction B2. The rod 780 draws the damping spring 760 which, in turn, pulls the cable 730 after a short time delay. The cable 730 rotates the rotating member 230 in direction B3, thereby rotating the rotatable rod 240 in direction, thereby returning the gate 20 into the closed position in the manner already described.

As the gate 20 approaches the second support structure 40, the latch 630 enters the aperture 710 of the gate catch 100. As the tapered edge 670 of the latch 630 strikes the lip 720 of the aperture 710, the latch 630 pivots until the lip 720 reaches the notch 660. At this point, the latch 630 will drops into a latched engagement with the gate catch 100, thereby securing the gate 20 in the closed position.

Thus, there has been described and illustrated herein a mechanically actuated barrier system operative from multiple remote locations. Those skilled in the art, however, will recognize that many modifications and variations besides those specifically mentioned may be made in the techniques described herein without departing substantially from the concept of the present invention. Accordingly, it should be clearly understood that the form of the invention as described herein is exemplary only and is not intended as a limitation of the scope of the invention.

What is claimed is:

1. An openable barrier for use with a horizontal support surface comprising:

a first support structure having at least one sidewall and an interior opening defined therein and a second support structure having a latch means, said first and second support structures fixedly mounted to said horizontal support surface and spaced apart from each other;

a barrier mounted to said first support structure and pivotable between a first position in which said latch means of said second support structure securely engages said barrier thereby impeding travel between said support structures and a second position in which said barrier permits travel between said support structures;

a first means, positioned at a first remote location and operatively connected with said latch means for releasing said latched engagement of said latch means with said barrier;

a pivoting means, positioned within said first support structure and operatively connected with said barrier, for pivoting said unlatched barrier into said second position;

a second means, positioned at a second remote location and operatively connected with said barrier for pivoting said barrier from said second position to said first position, said second means being operable only when said barrier is in said second position; and spring means operatively connected to said first support structure, said second means and said pivoting means, said spring means storing spring energy provided by said second means sufficient to pivot said barrier from said first position into said second position when said barrier is pivoted from said second position to said first position by said second means and releasing said stored energy to said pivoting means when said barrier is unlatched, thereby pivoting said barrier from said first position to said second position.

2. An openable barrier according to claim 1 wherein said second means for pivoting said barrier from said second position to said first position is positioned on one side of said barrier and said first means for releasing said latched engagement of said latch means is positioned on the other side of said barrier.

3. An openable barrier according to claim 2 and further comprising:

third means, positioned at a third remote location and operatively connected with said barrier, for pivoting said barrier from said second position to said first position, said third means being operable only when said barrier is in said second position;

said spring means operatively connected to said second and third means such that both of said second and third means switch into an inoperative mode when said barrier is pivoted into said first position; and a fourth means, positioned at a fourth remote location, operatively connected with said latch means and independent of said first means, for releasing said latched engagement of said latch means from said barrier.

4. An openable barrier according to claim 1 wherein said first support structure has at least one sidewall and an interior opening defined by said at least one sidewall and wherein said pivoting means positioned within said first support structure further comprises:

a rotating member having first and second ends;

means, connected to said rotating member and said barrier, for pivoting said unlatched barrier in response to rotation of said rotating member;

spring means connected to said rotating member and said sidewall, wherein spring energy sufficient to pivot said barrier is latched in said first position and is released when said barrier is unlatched, thereby rotating said rotating member in a first direction which pivots said barrier from said first position into said second position.

5. An openable barrier according to claim 4 wherein said spring means further comprises:

a first compression spring attached, at a first end, to said first end of said rotating member and, at a second end, to said sidewall; and a second compression spring attached, at a first end, to said second end of said rotating member and, at a second end, to said sidewall.

6. An openable barrier according to claim 4 wherein said second means for pivoting said barrier from said second position into said first position is connected with said rotating member, said second means rotating said rotating member in a second direction which pivots said barrier from said second position into said first position, wherein the rotation of said rotating member in said second direction stores sufficient spring energy in said spring means to pivot said barrier from said first position to said second position.

7. An openable barrier according to claim 6 wherein said latching means further comprises means for automatically latching said barrier to said second support structure when said barrier is pivoted into said first position.

8. An openable barrier according to claim 7 wherein said second means, for pivoting said barrier from said second position into said first position further comprises:

a depressible pedal;

means, connected to said rotating member, for raising said pedal into a depressible position in response to the rotation of said rotating member in said first direction;

wherein the depression of said pedal from said raised position rotates said rotating member in said second direction, thereby pivoting said barrier from said second position into said first position.

9. An openable barrier according to claim 8 wherein said latch means further comprises a latch pivotally mounted to said second support structure, said latch having a tapered end and a notch formed along a lower surface thereof and wherein said barrier further comprises a projecting edge receivable in said notch to latch said barrier to said second support structure.

10. An openable barrier according to claim 9 wherein said second support structure has at least one sidewall and an interior opening defined by said at least one sidewall and further comprising rod means positioned within said second support structure for pivoting said latch a distance sufficient to disengage said projecting edge from said notch.

11. An openable barrier according to claim 10 wherein said latch further comprises:

a main body portion having a first end pivotally mounted to said second support structure and a free end, said notch formed along said lower surface of said main body portion proximate to said free end thereof;

a tapered body portion integrally formed with and extending from said free end of main body portion;

a orthogonal projection extending from said first end of said main body portion; and spring means connecting said orthogonal projection to said second support structure, said spring means biasing said latch towards said rod means.

12. An openable barrier according to claim 10 wherein said means, positioned at a first remote location, for releasing said latched engagement of said latch means and said barrier further comprises:

a third support structure fixedly mounted to said horizontal surface at said first remote location, said third support structure having at least one sidewall and an interior opening defined by said sidewall;

a lever pivotable between first and second positions, said lever having one end extending into said interior of said third support structure;

linkage means mechanically associating said lever end and said rod means;

wherein said linkage means drives said rod means into releasing said latched engagement of said projecting edge and said notch in response to pivoting said lever into said second position and resets said rod means in response to pivoting said lever into said first position.

13. An openable barrier according to claim 12 wherein said linkage means extends from said interior of said third support structure, beneath said horizontal surface and into said interior of said second support structure.

14. An openable barrier according to claim 12 wherein said linkage means mechanically associating said lever end and said rod means further comprises:

first linkage means mechanically associated with said lever end; and second linkage means mechanically associating said first linkage means and said rod means;

wherein said first linkage means extends from said interior of said third support structure, beneath said horizontal surface and into said interior of said first support structure and said second linkage means extends from said interior of said first support structure, beneath said horizontal surface and into said interior of said second support structure.

15. An openable barrier according to claim 14 and further comprising:

a fourth support structure supported beneath said horizontal surface, said fourth support structure having at least one sidewall defining an interior opening therein, said depressible pedal pivotally mounted to said sidewall to define a top wall for said fourth support structure;

wherein said means for raising said pedal into a depressible position in response to the rotation of said rotating member in said first direction further comprising third linkage means mechanically associating said pedal and said rotating member.

16. An openable barrier according to claim 15 wherein said third linkage means extends from said interior of said first support structure, beneath said horizontal surface and into said interior of said fourth support structure.

17. A openable barrier for use with a horizontal surface comprising:

a first support structure fixedly mounted to said horizontal surface at a first location, said first support structure having at least one exterior sidewall and an interior opening defined by said exterior sidewall;

a second support structure fixedly mounted to said horizontal surface at a second location, said second support structure having at least one exterior sidewall having an aperture formed therein, an interior opening defined by said exterior sidewall and an interior sidewall supportably mounted by said exterior sidewall;

latch means mounted to said interior sidewall and pivotable between first and second positions;

a barrier mounted to said first support structure and pivotable between a first position in which said barrier impedes travel between said first and second support structures and in which a projection of said barrier engages said latch means to fixedly secure said barrier in said first position and a second position in which said barrier permits travel between said first and second support structures;

a third support structure fixedly mounted to said horizontal surface at a third location, said third support structure having at least one exterior sidewall and an interior opening defined by said exterior sidewall;

a lever pivotable between first and second positions, said lever having one end extending into said interior of said third support structure;

first linkage means mechanically associating said lever end and said latch means, said first linkage means driving said latch means into said first position whereby said barrier is unlatched in response to pivoting said lever into said second position;

a rotating member positioned in said interior opening of said first support structure, said rotating member having first and second ends;

means, connected to said rotating member and said barrier, for pivoting said unlatched barrier into said second position in response to rotation of said rotating member in a first direction;

spring means connected between said rotating member and said exterior sidewall of said first support structure, said spring means storing spring energy sufficient to pivot said barrier from said first position into said second position when said barrier is latched in said first position and releasing said stored energy when said barrier is unlatched, thereby rotating said rotating member in said first direction and pivoting said barrier into said second position;

a fourth support structure supported beneath said horizontal surface, said fourth support structure having at least one sidewall defining an interior opening therein and a top wall pivotable between a first position generally planar with said horizontal surface and a second position projecting therefrom;

second linkage means mechanically associating said top surface of said fourth support structure and said rotating member, said second linkage means driving said top surface into said second position in response to said rotation of said rotating member in said first direction and driving said rotating member in said second direction in response to an external force depressing said projecting top surface into said first position, said rotation of said rotating member in said second direction pivoting said barrier from said second position into said first position and storing sufficient spring energy in said spring means to pivot said barrier from said first position to said second position, said barrier pivoting into said first position pivoting said latch means into engagement with said barrier.

18. An openable barrier according to claim 17 wherein said first linkage means is attached, at one end, to said end of said lever, and extends from said interior of said third support structure, beneath said horizontal surface and into said interior of said second support structure where said first linkage means is attached, at the other end, to said latch means.

19. An openable barrier according to claim 18 wherein said second linkage means is attached, at one end, to said rotating member, and extends from said interior of said first support structure, beneath said horizontal surface and into said interior of said fourth support structure where said second linkage means is attached, at the other end, to said top surface of said fourth support structure.

20. An openable barrier according to claim 19 wherein said spring means further comprises:

a first compression spring attached, at a first end, to said first end of said rotating member and, at a second end, to said exterior sidewall of said first support structure; and a second compression spring attached, at a first end, to said second end of said rotating member and, at a second end, to said exterior sidewall of said first support structure.

21. An openable barrier for use with a horizontal support surface, comprising:

a first support structure having at least one sidewall and an interior opening defined therein and a second support structure having a latch means, at least one sidewall, an interior opening defined by said sidewall, and a rod means positioned within said second support structure for operatively disengaging said latch means, said first and second support structures fixedly mounted to said horizontal support surface and spaced apart from each other;

a barrier mounted to said first support structure and pivotable between a first position in which said latch means of said second support structure securely engages said barrier thereby impeding travel between said support structures and a second position in which said barrier permits travel between said support structures;

a first means, positioned at a first remote location and operatively connected with said rod means for actuating said rod means to operative disengagement of said latch means with said barrier;

a pivoting means, positioned within said first support structure and operatively connected with said barrier, for pivoting said unlatched barrier into said second position;

a second means, positioned at a second remote location and operatively connected with said barrier for pivoting said barrier from said second position to said first position, said second means being operable only when said barrier is in said second position; and spring means operatively connected to said first support structure, said second means and said pivoting means, said spring means storing spring energy provided by said second means sufficient to pivot said barrier from said first position into said second position when said barrier is pivoted from said second position to said first position by said second means and releasing said stored energy to said pivoting means when said barrier is unlatched, thereby pivoting said barrier from said first position to said second position.

* * * * *